United States Patent [19]

Kikta et al.

[11] Patent Number: 4,590,344

[45] Date of Patent: May 20, 1986

[54] MACHINE INSERTABLE DIP SWITCH

[75] Inventors: Donald D. Kikta, Downers Grove; Kent E. Regnier, Lombard, both of Ill.

[73] Assignee: Grayhill, Inc., LaGrange, Ill.

[21] Appl. No.: 621,216

[22] Filed: Jun. 15, 1984

Related U.S. Application Data

[63] Continuation-in-part of Ser. No. 458,341, Jan. 17, 1983, abandoned.

[51] Int. Cl.[4] ..... H01H 1/06

[52] U.S. Cl. ..... 200/291; 200/16 C

[58] Field of Search ..... 200/291, 16 C, 5 A

[56] References Cited

U.S. PATENT DOCUMENTS

| | | | |
|---|---|---|---|
| 3,249,730 | 5/1966 | Felson | 200/277 |
| 3,757,060 | 9/1973 | Ianuzzi et al. | 200/277 |
| 3,792,210 | 2/1974 | O'Dea et al. | 200/77 |
| 3,958,090 | 5/1976 | Garcia | 200/5 A |
| 3,971,905 | 7/1976 | Delaage | 200/277 |
| 4,072,834 | 2/1978 | Godfrey | 200/16 C |
| 4,168,404 | 9/1979 | Lockard | 200/16 D |
| 4,326,110 | 4/1982 | Zdanys, Jr. | 200/16 R |
| 4,352,964 | 10/1982 | English | 200/5 A |

*Primary Examiner*—Stephen Marcus
*Assistant Examiner*—Renee S. Luebke
*Attorney, Agent, or Firm*—Lloyd L. Zickert

[57] ABSTRACT

A machine insertable DIP switch having the same dimensions as an integrated circuit module which includes a base having molded-in terminal contact elements, a slider for each pair of contacts and carrying a spring-biased contact member of cup or ball shape and a cover holding the sliders within the base. Each slider receives a contactor such that in one position the contacts will be normally closed and in a diametrically opposed position the contacts will be normally open while the actuating tab or button of the slider remains in the same position with respect to the cover and base.

34 Claims, 39 Drawing Figures

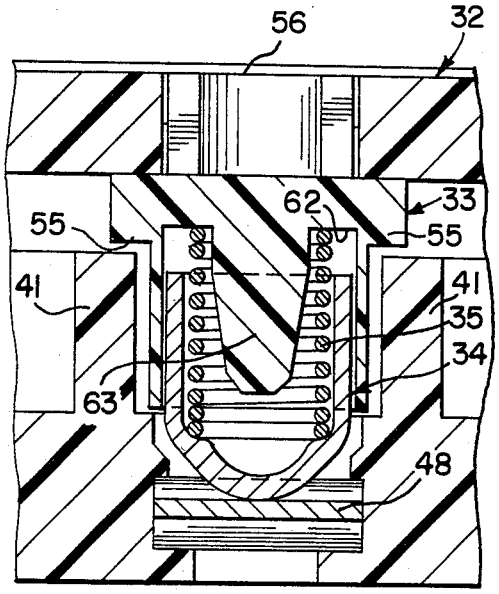
FIG. 9
FIG. 10
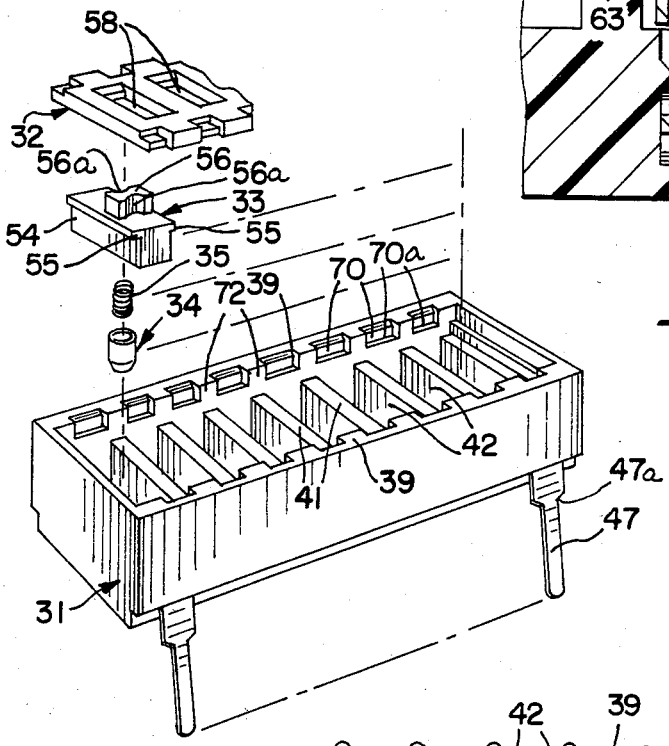
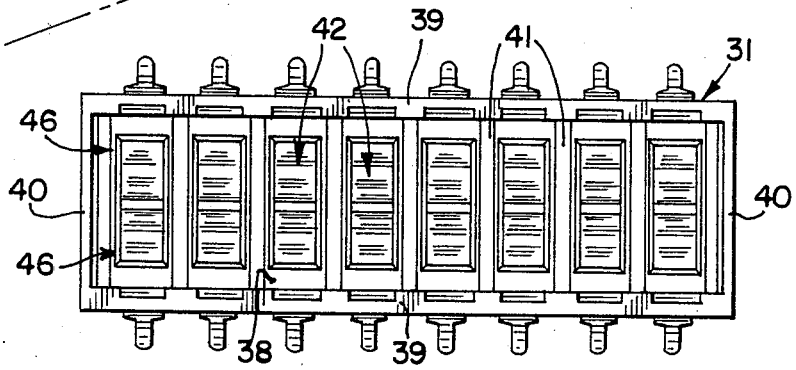
FIG. 11

MACHINE INSERTABLE DIP SWITCH

This application is a continuation-in-part of my copending application Ser. No. 458,341, filed Jan. 17, 1983, now abandoned.

This invention relates in general to dual inline package (DIP) switches, and more particularly to a DIP switch that is machine insertable on a printed circuit board, and still more particularly to a slide DIP switch having substantially the same dimensions and profile as a standard DIP integrated circuit module so that it can be mounted on a printed circuit board with the same automatic insertion equipment used to mount DIP integrated circuit modules on printed circuit boards, and still more particularly to a machine insertable DIP switch capable of providing multiple pole and throw combinations.

BACKGROUND OF THE INVENTION

Heretofore, there have been many types of DIP switches available for hand insertion onto a printed circuit board. Because of a need to reduce labor costs, the electronic industry has sought a DIP switch that can be machine inserted on a board with standard available equipment.

Automatic machines for machine inserting DIP integrated circuit modules have been developed and are commercially available but are restricted to handle modules within a given size range. Thus, a DIP switch having the dimensions and configuration within that size range can also be machine inserted on printed circuit boards by the same machines.

One known machine insertable DIP switch includes a slide-type contactor of the leaf-spring type, as shown in U.S. Pat. No. 4,352,964. It is well known that the life and reliability of a leaf-spring type switch is materially less than those switches not using leaf springs such as the ball contactor switch shown in U.S. Pat. No. 4,031,345. Moreover, it is not possible in the known machine insertable DIP switches to change the switching mode, such as between a normally open or normally closed type, except by changing parts of the switch.

The problems involved in making a machine insertable DIP switch include the necessity to compactly design the switch with a low profile so that its height, width and length are within the size range of a machine for handling DIP integrated circuit modules and so that the terminals are arranged on the outside of the switch housing for gripping and handling by the insertion equipment. The DIP switch of the present invention can be machine inserted by that automatic insertion equipment in a printed circuit board, thereby eliminating hand insertion methods of saving labor costs.

SUMMARY OF THE INVENTION

The DIP switch of the present invention is dimensioned and profiled like an integrated circuit module, and is easy to assemble and highly reliable in operation. It is of the slide type and the slider is structured so that it can be disposed in the base in either of two positions so that its contactor will be in the normally open or normally closed position when the actuating button is positioned at the same side of the switch cover. The cover is secured to the base after insertion by heat staking, ultrasonic welding or forming, utilizing adhesives, or by structuring it and the base so that it will snap into seated position and be locked in place. The exposed ends of the slider buttons are essentially flush or below the top surface of the base and preferably flush or below the cover to facilitate handling by the automatic insertion equipment.

The switch may include single and/or plural sliders, and the plural sliders may be internally or externally tied together to define multiple pole and throw combinations. The coaction between the sliders and the cover and slider actuator openings are such as to define a dust shield for the contact elements.

It is therefore an object of the present invention to provide an improved machine insertable DIP switch capable of being machine loaded on a printed circuit board by automatic DIP integrated circuit module insertion equipment.

Another object of the present invention is in the provision of a slide-type machine insertable DIP switch with a slider that can be selectively oriented when assembling in the housing such that its contactor may be in a normally open or normally closed position.

A further object of the present invention is in the provision of a machine insertable DIP switch having a relatively small number of parts that may be easily assembled and which will provide a highly reliable and relatively contaminant-proof switch capable of having a long operating life.

A still further object of the present invention is to provide a machine insertable DIP switch of the slide type which can be assembled to provide multiple pole and throw combinations in a single base.

Another object of the invention is to provide a machine insertable DIP switch of the slide type which is constructed such that the contacts are shielded from external elements to be dust-proof.

Other objects, features and advantages of the invention will be apparent from the following detailed disclosure, taken in conjunction with the accompanying sheets of drawings, wherein like reference numerals refer to like parts, in which:

BRIEF DESCRIPTION OF THE DRAWINGS

FIG. 9 is a greatly enlarged detailed sectional view taken generally along line 9—9 of FIG. 2;

FIG. 10 is an exploded perspective view of the switch of FIG. 1 and with some parts omitted for purposes of clarity and with the cover being shown only fragmentarily;

FIG. 11 is a top plan view of the base of the switch prior to assembling the sliders with the contactors and springs and the cover member;

DESCRIPTION OF THE PREFERRED EMBODIMENTS

Figure 1:
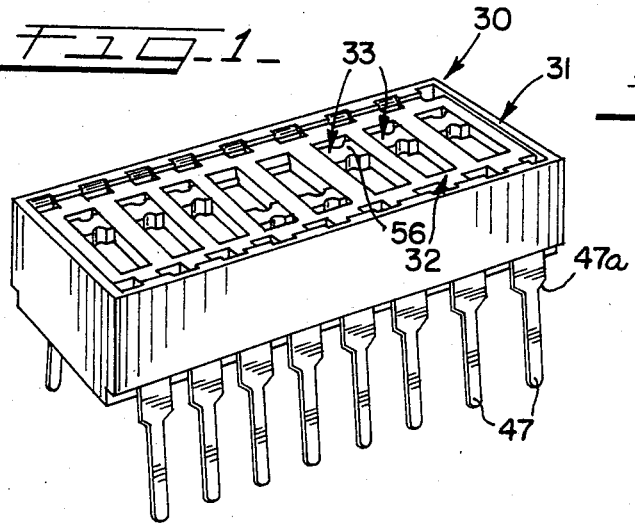
FIG. 1 is a perspective view of the machine insertable DIP switch of the invention.
Figure 5:
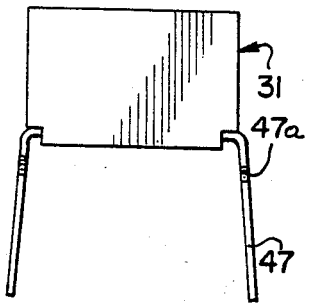
FIG. 5 is an end elevational view of the switch of FIG. 1.

Referring now to the drawings and particularly to FIGS. 1 to 6, one form of the machine insertable DIP switch of the present invention is generally indicated by the numeral 30 and includes a base 31, a cover 32, a plurality of slide actuators or sliders 33 and a cup-shaped contactor 34 and a helical or coil spring 35 associated with each slider 33. The switch 30 is commonly referred to as an eight-position switch which includes eight individual switching units. It may be appreciated that the present invention is applicable to a switch having any desired number of switch units.

The base, cover and sliders are of a suitable moldable thermoplastic having suitable electrical insulating and strength characteristics. The contactor, together with the terminal elements hereinafter referred to, will be made of a suitable electrical conductive material, and the spring will be of a suitable spring material.

The outer contour of the switch according to the invention is dimensioned so that it can then be machine inserted into a printed circuit board by commercially available machine insertion equipment used for inserting DIP integrated circuit modules.

The base 31, as seen particularly in FIGS. 6 to 11, includes a bottom wall 38, parallel opposed and upstanding side walls 39, and end walls 40. A plurality of equally spaced apart partitions 41 extending parallel to each other and between the opposed side walls, and integral with the bottom and side walls, define a plurality of juxtaposed switch sites 42. Slidably received within each switch site, as will be more clearly explained, is a slider with a contactor and a spring.

Terminal means in the form of a pair of terminal elements 46 are molded in the base at each of the switch sites. While the terminal elements are identically shaped, they are arranged in mirror relation relative to each other, as seen particularly in FIGS. 6 to 11.

Figure 2:
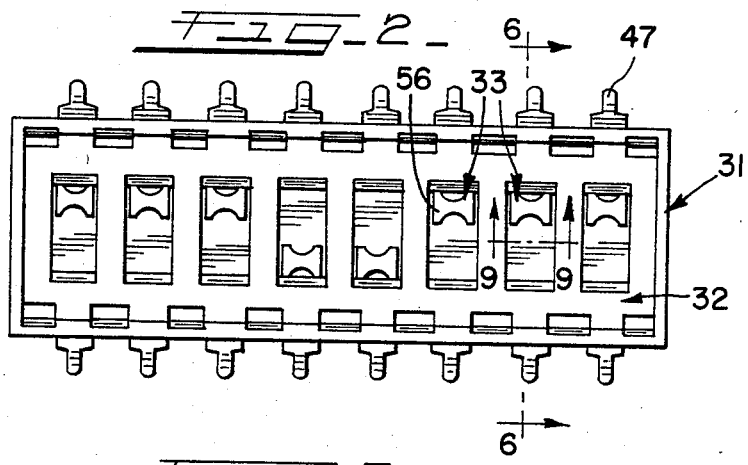
FIG. 2 is a top plan view of the switch of FIG. 1.
Figure 3:
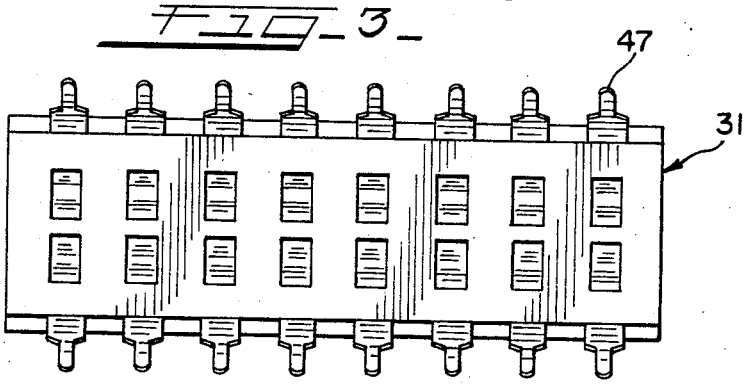
FIG. 3 is a bottom plan view of the switch of FIG. 1.
Figure 4:
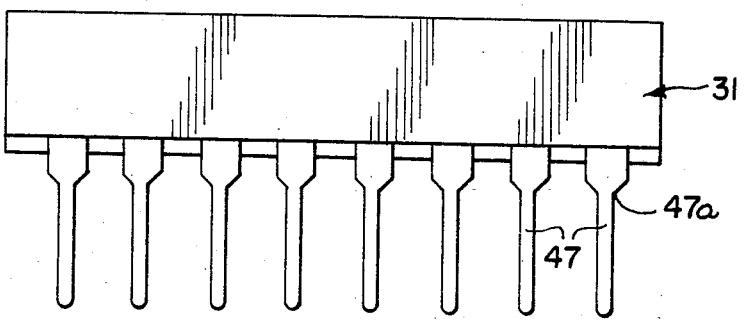
FIG. 4 is a side elevational view of the switch of FIG. 1.
Figure 6:
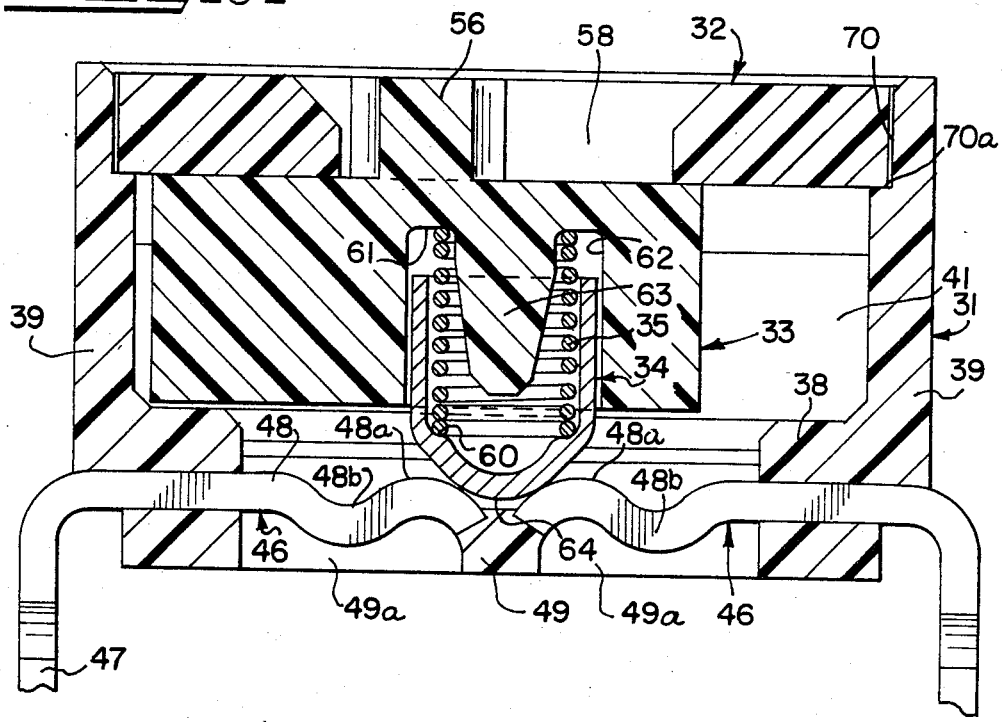
FIG. 6 is a greatly enlarged transverse sectional view of the switch taken generally along line 6—6 of FIG. 2 and showing the switch in closed position.

Each terminal element 46 includes a terminal leg 47 and a terminal arm 48. The terminal leg extends generally at right angles to the terminal arm and downwardly and on the outside of the base, as seen in FIGS. 2, 3 and 6. The terminal leg or terminal is adapted to be inserted onto an opening in the printed circuit board. Each terminal leg includes a beveled standoff 47*a* having beveled edges on opposite sides of the leg and which engage the printed circuit board and seats the switch in spaced relation from the board surface. When seating, the standoffs may partially penetrate the board which defines a firm seated position. Each terminal arm 48 is fixed to the base and defines a contact that is disposed within the base for engagement by the contactor 34. The upper surface of each contact 48 from the inner free end thereof is undulated and includes a convex portion 48*a* and a concave portion 48*b* which defines a detenting structure for the contactor 34. The undulations of the contacts are preferably formed as the mold in which the base is molded closes, but they could be formed prior to molding. Thus, the terminal arms have inclined curvate contact surfaces. The free ends of the terminal arms or contacts are separated by a longitudinally extending bar portion 49 of the base which insulates the contacts from each other. The inner ends of the arms are centrally disposed with opposed curvate surfaces defining a gap betwen the ends. As seen particularly in FIG. 9, each contact is held in place against vertical or other movement by molded material at the upper and lower opposite edges so that the disposition of the contacts relative to the base and the contactor remains constant. Openings 49*a* are molded in the base below the contacts for purposes of facilitating the holding and forming of the contacts during the molding and contact forming process. However, since the contacts or terminal arms are closed off at opposite edges by molded material, the interior of the switch is not exposed to contamination through the openings 49*a*.

Each slide actuator or slider 33 includes an elongated body 54 having a longitudinal dimension less than the distance between the opposite side walls of the base so that it can be slidably moved back and forth in a switch site. The width of the body 54 is less than the spacing between adjacent partitions 41 as can be seen particularly in FIG. 9 to allow for ease of slidable movement. Lips or rails 55 are integrally formed longitudinally along the opposite sides of the body portion 54 and are sized such that the width of the slider at the lips is greater than the distance between adjacent partitions. The lips are disposed between the top edges of the partitions and the underside of the cover 32. In the event of excess downward pressure on the slider, the lips will engage the upper edges of the partitions, thereby limiting downward movement and thereby protecting the bottom of the base at the contact area against damage. Because of the spring 35, as will be further explained, the slider is urged against the underside of the cover as shown in FIG. 9 where the upper surface of the slider slidably engages the undersurface of the cover.

Figure 7:
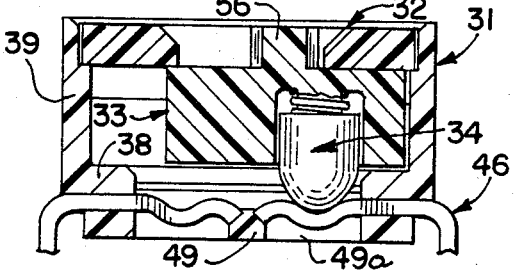
FIG. 7 is a transverse sectional view similar to FIG. 6 but showing the switch in open position.
Figure 8:
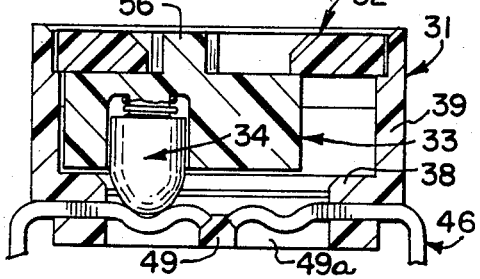
FIG. 8 is a view like FIG. 6 with the slider turned 180 degrees to illustrate an alternative assembly of the switch and where the particular switch will be in normally open position with the slider in the leftmost position.
Figure 12:
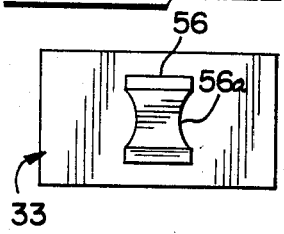
FIG. 12 is a top plan view of a single slider used in the switch.
Figure 13:
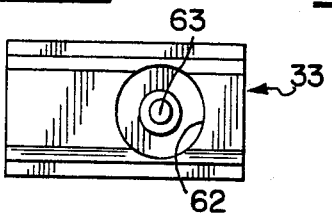
FIG. 13 is a bottom plan view of the slider.
Figure 14:
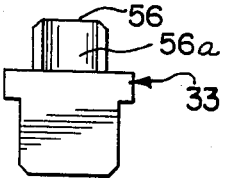
FIG. 14 is an end elevational view of the slider.

Extending from the upper surface of the slider is a button or actuator 56 having opposed cutouts or recesses 56*a* to facilitate engagement by a pointed tool such as the end of a pencil or ballpoint pen when engaged for purposes of moving the slider in the base between either of its two positions. Each button 56 is freely received in a slot or opening 58 formed in the cover 32 and in alignment with the position of a slider. The width of the button 56, as seen in FIG. 9, may be greater or less than shown. The button height is such that the top surface of the button is flush with or slightly below the top surface of the cover 32. As seen in FIGS. 6, 7 and 8, the top edge of the base side walls 39 are slightly higher than the top surface of the cover. The length of the slider is sized so that the slider may move between two extreme positions for purposes of positioning the slider in an "on" or "off" position. Both the partitions at a switch site and an opening in the cover guide the movement of the slider along a rectilinear path and coact to maintain the slider in alignment with a pair of terminal arms.

Each container 34 is cup-shaped and open at the upper end for receiving a spring 35. The spring is bottomed within the cup-shaped member on a shoulder 60 and against a bottom wall 61 of a cavity or blind hole 62 formed in the slider 33. A guide stem 63 formed in the cavity 62 receives the spring 35 to maintain it in properly guided relationship with the contactor 34. Together, the slider and contactor form a slider-contactor subassembly that coacts with a pair of contacts. As above mentioned, when the slider-contactor and spring are in assembled relation, the spring urges the contactor down into engagement with the contacts and the slider up into engagement with the contacts and the slider up into engagement with the underside of the cover 32. The outer free end of the contactor 34 is spherically shaped at 64 for engagement either with both contacts 48 as seen in FIG. 6 to close the circuit of the contacts, or the concave portion 48*b* of the terminal arm on the right side, at which time the circuit between the contacts is broken and the switch is in "off" position. As the slider moves between "on" and "off" positions, the contactor will ride up and over the convex portion 48*a* but always be in spring-biased contact with either the one terminal arm or the contact portions of both terminal arms. Moreover, slidable movement of the slider and the contactor between "on" and "off" positions will effect a wiping action to assure a good and reliable electrical contact between the contactor and the contacts and a detecting action will be felt through the slider.

The fit between the contactor 34 and the cavity 62 of the slider is such that the contactor will move freely within the cavity as it rides over the high point of a contact. Because of the depth of the cavity in the slider and the bottoming of the spring 35 adjacent the contacting end of the contactor, the spring length is such as to give long life to the spring and to provide the desired resiliency and spring pressure of the contactor against the contacts. The cavity depth is nearly equal to the height of the slider so that the spring can be received therein and permit the switch to have a low profile. Further, the travel of the slider between the side walls of the base is such that it can slightly overtravel the gap or at least reach the center of the gap when the contactor is moved to closed position in order to allow some wiping on the contacts at the end of the slider travel. Note in FIG. 6 that the slider 33 can be moved slightly more to the left to provide the overtravel function and the wiping of the left-hand contact 48.

Figure 15:
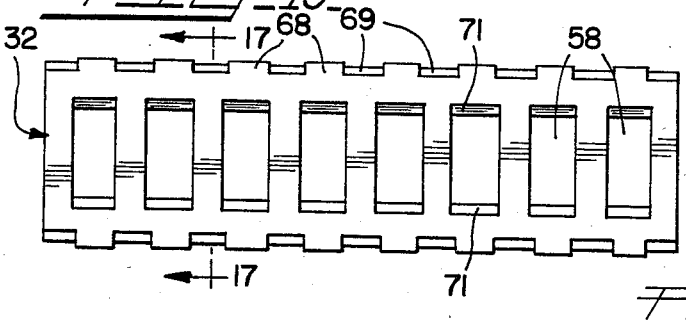
FIG. 15 is a top plan view of the cover of the switch.
Figure 16:
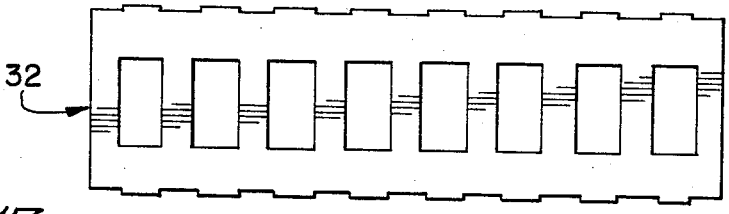
FIG. 16 is a bottom plan view of the cover.
Figure 17:
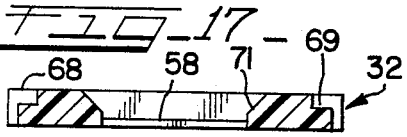
FIG. 17 is a transverse sectional view of the cover taken substantially along line 17—17 of FIG. 15.

As seen particularly in FIGS. 15 and 16, the opposite side edges of the cover 32 are serrated and include a plurality of equally spaced apart guide projections 68 between which are disposed recesses 69 on the top surface which, as will be explained, facilitate the staking of the cover to the base. The guide projections 68 are matingly received in slots 70 formed at the upper edges of the opposed side walls 39 and seat on the bottoms 70*a* of the slots, thereby disposing the cover at a predetermined position relative to the base. The undersurface of the cover 32 is planar, as seen in FIG. 16, whereby the sliders 33 engage the undersurface when the cover is properly assembled with the base. The opposite edges of the openings 58 are beveled at 71 to facilitate the engagement between an actuating tool and a button on a slider.

Figure 18:
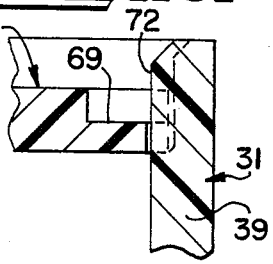
FIG. 18 is an enlarged vertical sectional view taken between sliders through a side wall of the base and the adjacent part of the cover in assembled relation with the base but prior to staking of the cover to the base.

While the manner of assembling the cover, sliders, contactors, and springs with respect to the base may vary, it has been found to be satisfactory to dispose the cover in an upside-down relation, place sliders on the cover by inserting the buttons of sliders in the slide openings 58, inserting springs 35 over the guide stem 63 in the cavities 62 of the sliders, telescopically position contactors 34 over the springs, and then bring the base 31 into coacting relation with the sliders and cover until the cover is seated on the recessed shoulders 70*a*, as particularly illustrated in FIG. 18.

Figure 19:
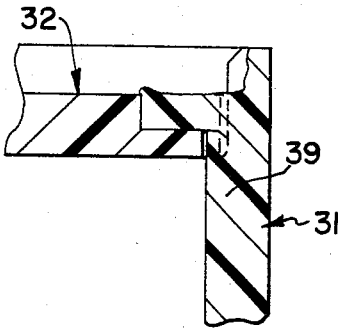
FIG. 19 is a view like FIG. 18 but illustrating the cover staked to the base.
Figure 20:
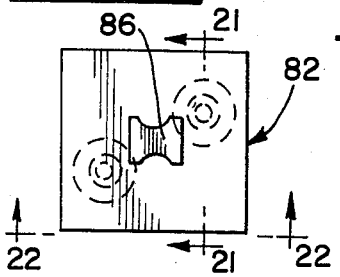
FIG. 20 is a top plan view of a multiple contactor slider which comprises a pair of sliders tied together internally of the switch housing.
Figure 21:
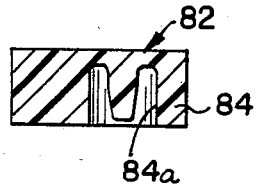
FIG. 21 is a vertical sectional view taken through the slider of FIG. 20 and generally along lines 21—21 thereof.
Figure 22:
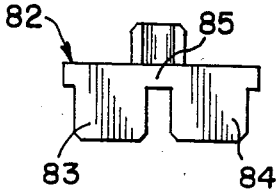
FIG. 22 is an end elevational view of the slider of FIG. 20 looking in the direction of the arrows along line 22—22.

Thereafter, a staking operation is effected to stake the cover to the base by applying a heated tool from the top side of the switch to effectively displace a portion of the upper side walls at 72 into the recesses 69. Removal of the heat allows the material to cool and harden and thereafter lock the cover in place, as particularly illustrated in FIG. 19 and also in FIG. 6. It should be further recognized that the cover could be ultrasonically welded or formed to secure it to the base.

The sliders 33 are uniquely formed so that they may be inserted in the base in opposite position by rotating them 180 degrees so that when the button is disposed at the left-hand end of the slide opening 58, as seen in FIG. 8, the switch will be open by virtue of the contactor being only in contact with the left-hand contact 48. Thus, the cavity may be disposed to position the contactor between the gap or at one of the contacts depending upon contactor orientation. The reversibility feature gives the switch the capability of having adjacent positions tied together such as connecting adjacent sliders with a suitable link to give single-pole double-throw or any multiples thereof switching capability and to give a particular position a normally open or normally closed capability. For example, two adjacent sliders with their buttons in the same position may be arranged to have the contactor of one in closed position and the contactor of the other in open position and after which movement of the sliders to the other side of the switch will reverse these conditions. It may be appreciated that any combination or arrangement can be provided with this unique slider contactor construction. Plural sliders may be internally or externally tied together.

As previously mentioned, a switch of the present invention is versatile in that it can be assembled with some different parts to provide multiple pole and throw combinations for a single base. Use of a common base substantially reduces the molding costs and inventory of bases while allowing various multiple pole and throw combinations to be constructed for handling whatever circuit switching requirements may be desired. While plural slider assemblies may be externally tied, it is preferable to internally tie these slider assemblies as illustrated by the embodiments of FIGS. 20 to 27.

Figure 27:
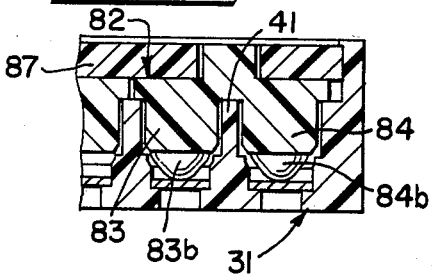
FIG. 27 is a longitudinal sectional view taken through the switch of FIG. 26 and generally along line 27—27 thereof.

More particularly, a multiple slider, generally designated by the numeral 82, of one type is illustrated in FIGS. 20 to 23 and includes dual slider portions 83 and 84 internally tied together by a tie bar 85 which also serves to ride on a partition 41 of the base 31. As further seen in FIG. 23, each slider portion 83 and 84 includes contactor and spring cavities **83*a* and 84*a* which are adapted to receive contactors and springs in the same fashion as in the first embodiment. As seen in FIG. 27, the contactors are designated 83*b* and 84*b*. An actuating button 86 extends from the top surface of the multiple slider and through an opening in the cover plate 87. It will be appreciated that the base 31 for the modified slider is identical to that of the earlier embodiment and that the cover plate differs only in the openings provided for receiving the actuating buttons which must be aligned with the position of the buttons as they are disposed in the base, as particularly seen in FIG. 26**.

Figure 26:
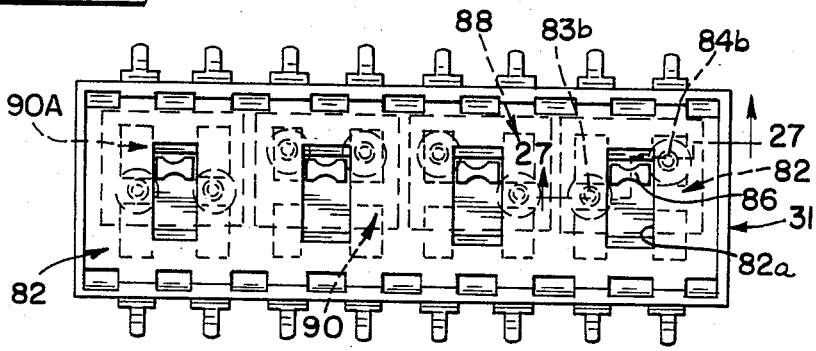
FIG. 26 is a top plan view of a switch according to the invention and illustrating various combinations of multiple pole and throw combinations.
Figure 29:
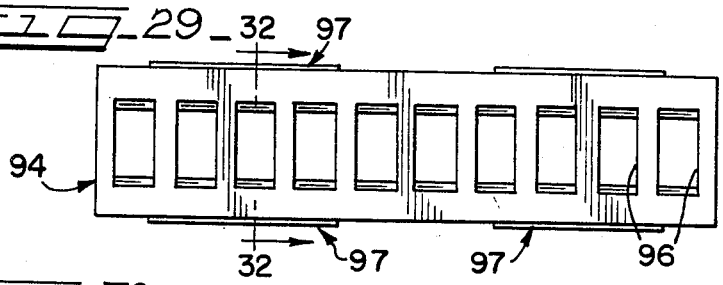
FIG. 29 is a top plan view of a modified cover plate for coaction with a modified base for defining a snap fit relation between the cover and the base.
Figure 30:
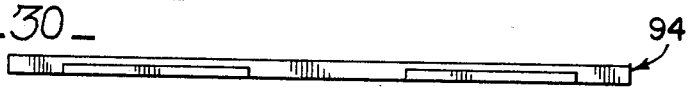
FIG. 30 is a side elevational view of the cover member of FIG. 29.
Figure 31:
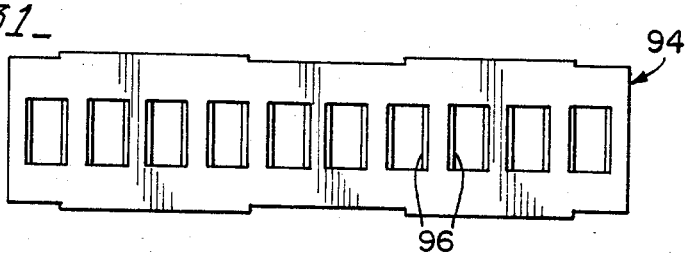
FIG. 31 is a bottom plan view of the cover member of FIG. 29.

Operation of the multiple slider 82 may be appreciated by referring to FIG. 26 where it appears at the right-hand end of the switch and where the contactor **83*b* is in normally closed position and the contactor 84*b* is in normally open position with the actuating button 86 at the upper end of the switch housing and the cover plate opening 82*a*. Movement of the switch to its other position places contactor 83*b* in open position relative to the contacts of the base and contactor 84*b*** in closed position. This slider provides a single-pole double-throw combination.

Figure 24:
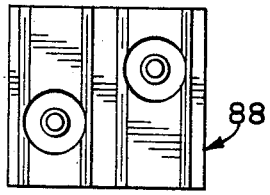
FIG. 24 is a bottom plan view of a modified slider where the contactors would be in the opposite positions from those of the slider in FIG. 23.

A modified multiple slider 88 is shown in FIG. 24 which differs from the slider 82 only in that the position of the contactor cavities of the slides are reversed to provide the opposite on-off action that is possible with the slider 82, as best illustrated in FIG. 26. Thus, if it is desired to obtain the switching capability of multiple slider 88, it is only necessary to utilize it at a desired terminal location.

Figure 25:
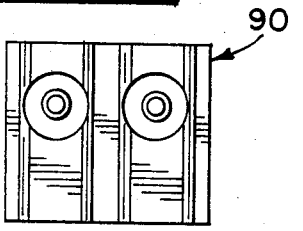
FIG. 25 is a bottom plan view of a still further modified slider where the contactors would be in alignment with each other.

Another version of the multiple slider is illustrated in FIG. 25 and is generally designated by the numeral 90 and which differs from the sliders 82 and 88 in that the cavities for the contactors are in alignment with each other rather than being staggered and for the purpose of providing a double-pole single-throw sliding arrangement, as also illustrated in FIG. 26. It may be seen in FIG. 26 that the position of the multiple slider 90 is such as to open the terminal contacts, and if it is desired to provide normally closed contacts with the actuating button in the same location, that can be accomplished by merely rotating the slider 90 180 degrees, as illustrated by the multiple slider 90A shown in FIG. 26.

Figure 23:
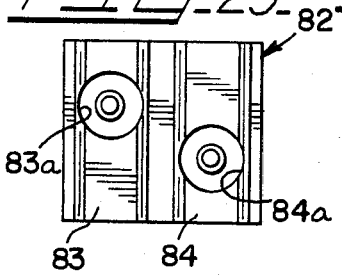
FIG. 23 is a bottom plan view of the slider of FIG. 20.
Figure 28:
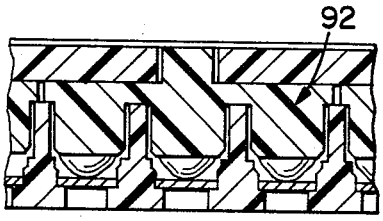
FIG. 28 is a view similar to FIG. 27 but illustrating three sliders internally tied together in a switch.

While the embodiments illustrated in FIGS. 23 to 25 show only a pair of sliders tied together, it may be appreciated that any number of sliders may be tied together. Another example is shown by the multiple slider 92 illustrated in FIG. 28 which shows three sliders tied together for simultaneously moving three contactors during actuation. The positions of the contactors may take on any desired form whether they all are in alignment or staggered relative to one another depending upon the switching desired for the circuit. It may also be appreciated where more than two sliders are internally tied together, the actuating slot in the cover must be in alignment with the actuating button, and accordingly, a corresponding cover member would be provided. However, the same terminal base assembly would be utilized no matter how many contactors are tied together. Thus, any number of pole and throw combinations can be provided with the present invention while utilizing the same terminal base.

An alternative system of securing the cover to the base involves structuring the cover and that portion of the base which receives the cover such that the cover snap fits into the base, thereby eliminating the need for staking or otherwise securing the cover to the base. An embodiment illustrating this snap fit arrangement is shown in FIGS. 29 to 34.

Referring first to FIGS. 29 to 33, a cover generally designated by the numeral 94 is shown to be received in snap fit relation with a base generally designated by the numeral 95. The cover is in the form of a flat plate similar to the cover 32 of the first embodiment and which likewise includes suitable openings 96 for receiving the button actuators of the sliders. Rather than serrating the opposite edges of the cover plate as in the cover plate 32, locking ribs or lips 97 are provided for coaction with locking grooves or slots 98 formed along the inside surfaces of the opposed vertical walls 99 of the base 95, as seen particularly in FIG. 33. While the length of the locking ribs along the opposite edges of the cover plate 94 is illustrated as being substantially less than the total length of the opposite edges, and the ribs are shown in pairs on the opposite edges, it may be appreciated that they may be of any suitable length and any number of ribs may be provided along each edge. This will depend largely on the overall length of the cover plate. In any event, the locking grooves 98 may be of substantially the same length as the locking ribs and disposed to align with the ribs when the cover plate is assembled or they may extend the entire length of the side walls of the base.

Figure 32:
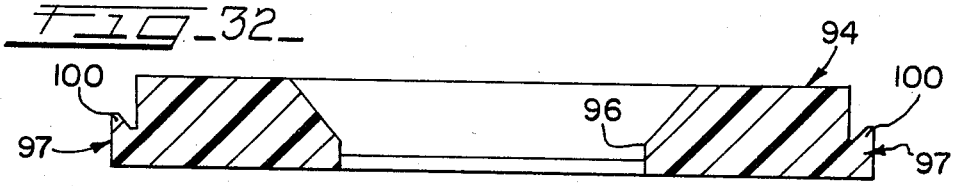
FIG. 32 is a greatly enlarged transverse sectional view taken through the cover plate of FIG. 29 and generally along line 32—32 thereof.
Figure 33:
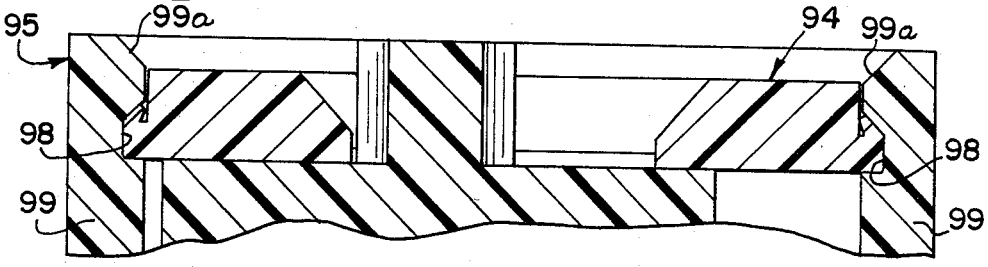
FIG. 33 is an enlarged detailed sectional view taken through a modified base and illustrating the manner in which the cover plate of FIG. 32 engages in locking relation with the base.

The height of the locking ribs 97, as seen particularly in FIG. 32, is less than the overall height or thickness of the cover plate and they are provided with tabs 100 at their upper ends which bend over or are deformed upon insertion in the locking grooves, as seen in FIG. 33, for the purpose of fully filling the grooves and providing a snug fit. The locking grooves are not rectangular in shape since the mold elements for making the base must be removed, and therefore the upper parts of the grooves are provided with an inclined surface to permit mold removal, and it is in that area that the tabs 100 are received to provide the tight fit with the base. In order to facilitate the insertion of the cover into the base, the upper interior edges of the vertical walls 99 are beveled at 99*a*. It will be appreciated that as the cover plate is inserted into snap-fit relation with the base, the upper ends of the vertical walls will slightly spread apart to allow the locking lips to pass into the grooves 98.

Figure 34:
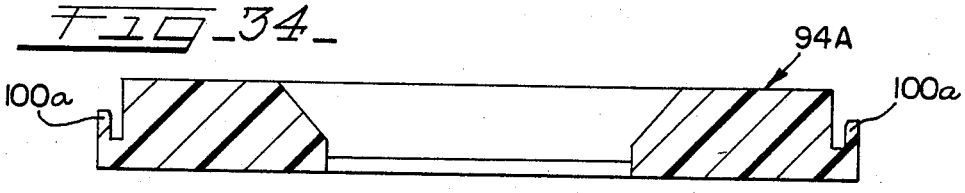
FIG. 34 is a sectional view like FIG. 32 but showing a modified snap-fit cover plate.

A modified snap-fit cover plate 94A is shown in FIG. 34 which differs from the embodiment of FIG. 3 only in the shape of the tabs 100*a*. While the tabs 100 are somewhat triangular in cross section, the tabs 100*a* are more rectangular in cross section. Insertion of the modified cover plate 94A into a base will be accomplished in the same manner as the insertion of the cover plate 94 and wherein the tabs 100*a* are deformed or break over toward the center of the cover plate and serve to fully fill the locking grooves to provide a tight snap-fit arrangement.

A modified slider contactor unit is shown in FIGS. 35 to 39 wherein the contactor is ball-shaped. Like housing and terminal parts are provided with the same numerals. The slider contactor unit includes a slider 110, a ball-shaped contactor 111, and a helical or coil spring 112. The overall size of the slider is substantially the same as the slider 33, and it may be ganged with other sliders in the same fashion as illustrated with respect to the above described slider contactor unit having the cup-shaped contactor.

The helical spring 112 is shorter than the spring 35 employed in the previous slider contactor unit but otherwise functions in the same manner in that it applies a biasing force between the slider and the contactor to continually urge the contactor into contact with the terminal elements 46 and the slider into contact with the cover 32. The undulated terminal elements having inclined curvate contact surfaces coact with the ball contactor when it slides thereover in producing a detecting function when the slider is moved between the "on" and "off" positions.

The slider 110 also differs from the slider 33 in that the spring and ball cavity 113 is in the form of a blind hole and the side wall of the cavity provides guidance for the spring 112. Likewise, the ball 111 is slidably and guidably received in the cavity. The spring stabilizing pin is therefore omitted. The spring is bottomed at one end against the blind end of the cavity and at the other end over the ball contactor, as particularly illustrated in FIG. 35. This cavity is slightly deeper than the cavity 62 in the slider 33. Cavity 113 is cylindrically formed and sized together with the diameter of the ball contactor 111 such that, when in assembled relation with respect to the terminal elements, the ball contactor will freely move in the cavity. Further, the dimensions of the slider, the ball and housing cause about one-half of the ball contactor to be received within the cavity when the slider is in a detent position at the "on" or "off" locations with respect to the terminal elements. Moving toward a detent position will cause the ball to depress the spring and slide into the cavity so that the ball can ride over the hump or high point of a terminal element.

Figure 35:
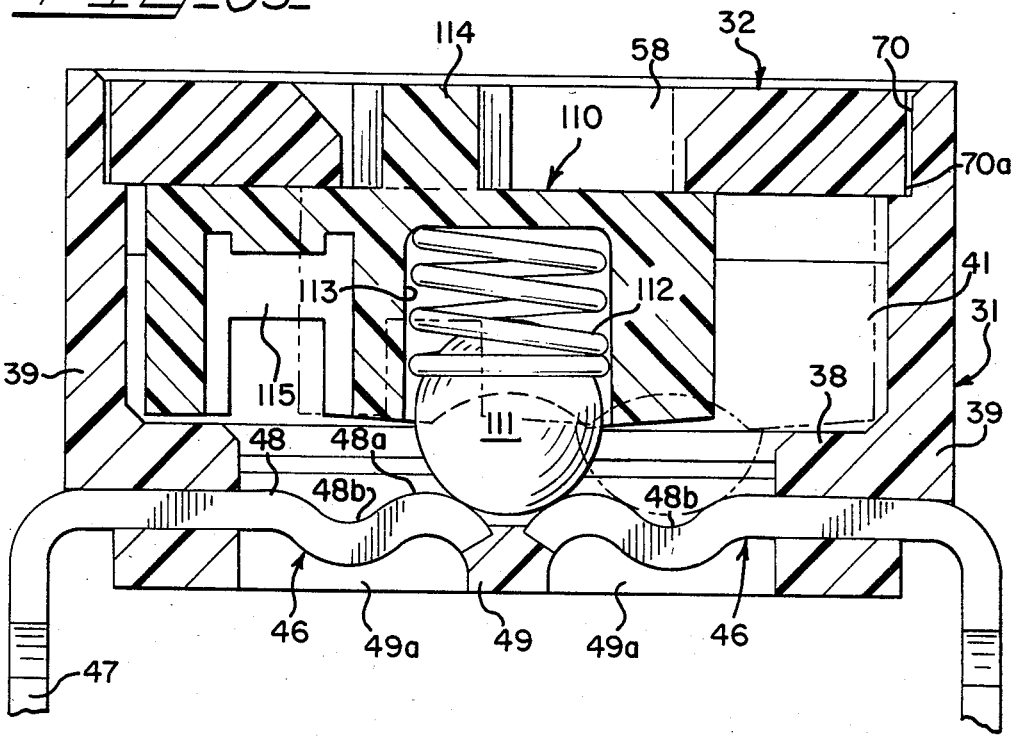
FIG. 35 is a greatly enlarged transverse sectional view like FIG. 6 showing a modified slider and contactor subassembly wherein the contactor is ball-shaped and showing the slider in the "on" position in solid lines and in the "off" position in phantom.
Figure 36:
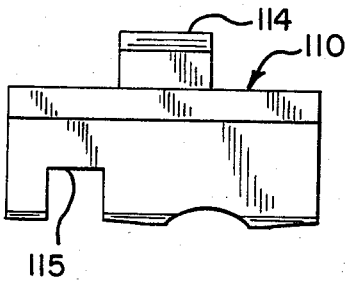
FIG. 36 is a side view of the slider from the switch of FIG. 35.
Figure 37:
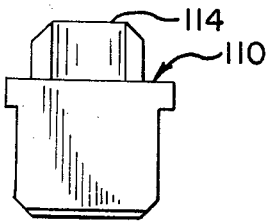
FIG. 37 is an end view of the slider.
Figure 38:
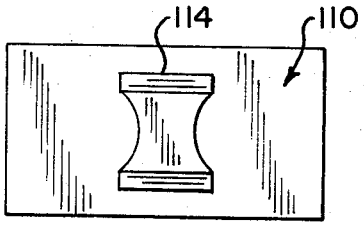
FIG. 38 is a top view of the slider.
Figure 39:
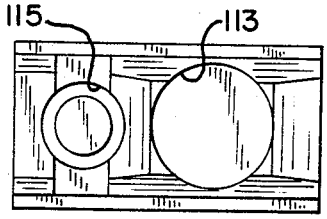
FIG. 39 is a bottom view of the slider.

Like the slider 33, the cavity is offset relative to the center of the slider whereby the slider may be disposed in either of two positions to enable the switch to be in a normally "on" or "off" position when the button 114 remains at the same position relative to the switch housing and slot in the cover. Thus, depending upon the installation of the slider, it will position the contactor either as shown in FIG. 35 or as illustrated with respect to the slider 33 in FIG. 8. A cavity and coacting slot 115 are provided at the other end of the slider for purposes of assisting in the orientation of the slider during assembly. This orientation slot may also be used in the slider 33 when positioning the cup contactor 34. Otherwise, the construction of the slider is essentially the same as the slider 33 utilizing the cup-shaped contactor, and it may be substituted for the cup-shaped contactor slider unit in the same housing for obtaining the same operation.

The preferable manner of assembling this embodiment is to dispose the base in the upright position, drop the ball contactors into position on the terminal contacts 48, insert the springs into the ball cavities with a small quantity of lubricant to hold them in place, insert the sliders and springs into place on the ball contactors, and then seat and secure the cover into place on the base.

It will be understood that modifications and variations may be effected without departing from the scope of the novel concepts of the present invention, but it is understood that this application is to be limited only by the scope of the appended claims.

The invention is hereby claimed as follows:

1. A machine insertable slide DIP switch for a printed circuit board comprising, a housing of electrical insulating material having top and bottom walls interconnected by opposed side and end walls, a plurality of electrically conductive terminal means molded into said bottom wall, said terminal means including a plurality of juxtaposed pairs of terminal elements, each said element including a terminal arm disposed in fixed relation within the housing and in spaced end-to-end relation to the terminal arm of the other terminal element of the pair, said terminal arms being of equal length, each pair of terminal arms being undulated to define inclined curvate contact surfaces over which a contactor slides and to define a pair of contacts at their inner ends having opposed curvate surfaces and being centrally disposed, and a terminal leg extending substantially at right angles to each said arm and downwardly from the bottom wall such that the legs of a pair of terminal elements are in opposed and spaced apart relation, and a plurality of slider-contactor units within the housing one for each pair of terminal elements, each unit having a slider, a contactor and a biasing means, each slider including a downwardly opening cavity of a depth substantially equal to the height of the slider, the lower surface of said slider being in closely spaced relation to said contacts, and an upwardly extending button actuator centrally disposed along said slider extending through an elongated opening in the top wall, each contactor being cup-shaped with the open end facing the cavity and the closed end engaging the contacts and sized to electrically connect the adjacent ends of the contacts when positioned therebetween, said contactor being slidably and matingly received by said cavity, and said biasing means being disposed within said contactor and biasing said contactor into engagement with said contacts and said slider into engagement with said top wall whereby the curvate surfaces of the undulated arms and the contacts thereon coact with the biased contactor to define a detenting action during movement of the slider-contactor units.

2. The switch defined by claim 1, wherein said cavity of each slider is disposed along said slider such that in one position relative to the terminal contacts the slider will dispose the contactor in engagement with both contacts and when the slider is assembled in a reversed position the contactor will be in engagement with only one contact.

3. The switch defined by claim 1, wherein the buttons are flush with or slightly below the top wall of the housing.

4. The switch defined by claim 1, wherein the closed end of the contactor is spherically shaped.

5. The switch defined by claim 1, wherein the contactor is substantially fully received within the cavity and only protruding sufficiently to engage the contacts.

6. The switch defined by claim 1, wherein said housing includes means for guidably aligning said slider-contactor units with a pair of terminal contacts.

7. The switch defined by claim 1, wherein the biasing means is a spring.

8. The switch defined by claim 7, wherein the spring is helical.

9. The switch defined by claim 1, and which further includes means for tying at least two sliders together for simultaneous movement and to define single or multiple pole and throw switching action.

10. The switch defined by claim 9, wherein said tying means is disposed internally of the switch housing.

11. The switch defined by claim 10, wherein the tying means includes a connecting means between said sliders.

12. The switch defined by claim 11, wherein the contactor cavities of said tied sliders may be staggered or aligned to produce the pole and throw switching action desired.

13. A machine insertable slide DIP switch for a printed circuit board comprising, a base having a bottom wall, upstanding and opposed side and end walls, a plurality of juxtaposed pairs of terminals molded into the base at the bottom wall, each terminal including a fixed terminal arm disposed within the base and a terminal leg disposed outside the base for connection to a printed circuit board, the terminal arms of each terminal pair being of the same length, insulated from each other and in opposed aligned relation to define contacts for a switch site, said contacts being undulated with the inner ends having curvate surfaces, a slider-contactor assembly for each switch site including a slider having a cavity extending from the bottom side to a depth slightly less than the height of the slider, a cup-shaped contactor telescopically and matingly slidable in said cavity, and means biasing said contactor out of the cavity and into engagement with said contacts, whereby slidable movement of said assembly will selectively position said contactor into engagement either with one contact for the "off" position or both contacts for the "on" position, and a cover secured to the upper open end of the base to close the base and retain the slider-contactor assemblies within the base, whereby the contactor coacts with the undulated contacts to define a detenting arrangement.

14. The switch defined by claim 13, wherein said biasing means includes a helical spring.

15. The switch defined by claim 14, wherein the cavity of each slider is disposed along the slider such that disposing the slider in one position in the base will position the contactor in engagement with both contacts and in a reverse position will position the contactor in engagement with only one contact.

16. A machine insertable slide DIP switch for a printed circuit board comprising, a base of electrically insulating material having a bottom wall, upstanding and opposed side and end walls, a plurality of juxtaposed switch sites between said end walls, means defining slideways for the switch sites, a plurality of electrically conductive terminal means molded in said base, each said terminal means including a pair of terminal elements, each terminal element having a terminal leg extending downwardly from the base and adapted to be received by said board and a fixed terminal arm defining a contact within the base along the bottom wall, said terminal elements of each pair being electrically insulated from each other and a pair of same defining a pair of contacts for a circuit, a plurality of sliders of electrically insulating material, one each movable in a switch site between the opposed side walls, each slider including a cavity on the bottom facing the contacts and a button actuator on the top, a cup-shaped electrically conductive contactor telescopically and matingly movable in said cavity having its closed end disposed for engagement with the contacts, resilient means within said cavity biasing said contactor into engagement with said contacts, and a cover of electrically insulating material secured to the base at the upper ends of the side and end walls to close the base and retain the sliders and contactors within the base, said cover having button actuator openings through which the button actuators extend, the upper surfaces of the button actuators being substantially flush with or slightly below the upper surface of said cover, and said sliders coacting with the cover and the openings therein to maintain the interior of the switch and the contacts and contactor dust free.

17. The switch defined by claim 16, wherein the means defining slideways include partitions integral with the bottom and side walls but of a height less than the height of the sliders.

18. The switch defined by claim 16, wherein said contacts have undulated surfaces engaged by said contactor to define a detenting action.

19. The switch defined by claim 18, wherein the closed end of the contactor is spherically shaped.

20. The switch defined by claim 16, wherein the inner ends of the contacts are centrally disposed between the side walls of the base, said button actuator of each slider being centrally positioned between the ends of the slider, and said cavity being offset from the button actuator such that when oriented in one position relative to the contacts the slider will dispose the contactor in engagement with both contacts and in the other position the slider will dispose the contactor in engagement with only one contact.

21. The switch defined by claim 20, wherein the base side walls are formed with latching means to receive the cover in snap-fit relation.

22. The switch defined by claim 21, wherein said latching means includes locking grooves and said cover includes locking ribs for mating with said grooves.

23. The switch defined by claim 16, wherein the opposed side edges of the cover are serrated and the inner opposed surfaces of the base side walls are serrated to matingly receive the cover.

24. The switch defined by claim 23, wherein the cover is heat staked to the base by displacing material of the side walls onto said cover.

25. The switch defined by claim 16, and which further includes means for tying at least two sliders together for simultaneous movement and to define single or multiple pole and throw switching actions.

26. The switch defined by claim 25, wherein said tying means is disposed internally of the switch housing.

27. The switch defined by claim 26, wherein the tying means includes a connecting means between said sliders.

28. The switch defined by claim 27, wherein the contactor cavities of said tied sliders may be staggered or aligned to produce the pole and throw switching action desired.

29. A machine insertable slide DIP switch for a printed circuit board comprising, a housing of electrical insulating material having top and bottom walls interconnected by opposed side and end walls, a plurality of electrically conductive terminal means molded into said bottom wall, said terminal means including a plurality of juxtaposed pairs of terminal elements, each said element including a terminal arm disposed in fixed relation within the housing and in spaced end-to-end relation to the terminal arm of the other terminal element of the pair, said terminal arms being of equal length, each terminal arm being undulated to define an undulated surface on and along which a contactor moves between "on" and "off" positions, each arm having an arcuate surface at its inner end coacting with the arcuate surface of the other arm to define a pair of contacts for the contactor centrally between the housing side walls, a rise over which the contactor moves from the "on" position to the "off" position, and stop means for the contactor in the "off" position, and each said element further including a terminal leg extending substantially at right angles to each said arm and downwardly from the bottom wall such that the legs of a pair of terminal elements are in opposed and spaced apart relation, and a plurality of slider-contactor units within the housing one for each pair of terminal elements, each unit having a slider, a contactor and a biasing means, each slider including a downwardly opening cavity of a depth substantially equal to the height of the slider, the lower surface of said slider being in closely spaced relation to said contacts, and an upwardly extending button actuator centrally disposed along said slider extending through an elongated opening in the top wall, each contactor having a spherical surface and engaging the contacts and sized to electrically connect the adjacent ends of the contacts when positioned therebetween, said contactor being slidably and matingly received by said cavity, and said biasing means being disposed within said slider and biasing said contactor into engagement with said contacts and said slider into engagement with said top wall whereby the curvate surfaces of the undulated arms and the contacts thereon coact with the biased contactor to define a detenting action during movvement of the slider-contactor units.

30. A machine insertable slide DIP switch for a printed circuit board comprising, a housing of electrical insulating material having top and bottom walls interconnected by opposed side and end walls, a plurality of electrically conductive terminal means molded into said bottom wall, said terminal means including a plurality of juxtaposed pairs of terminal elements, each said element including a terminal arm disposed in fixed relation within the housing and in spaced end-to-end relation to the terminal arm of the other terminal element of the pair, said terminal arms being of equal length, each terminal arm being undulated to define an undulated surface on and along which a contactor moves between "on" and "off" positions, each arm having an arcuate surface at its inner end coacting with the arcuate surface of the other arm to define a pair of contacts for the contactor centrally between the housing side walls, a rise over which the contactor moves from the "on" position to the "off" position, and stop means for the contactor in the "off" position, and said element further including a terminal leg extending substantially at right angles to each said arm and downwardly from the bottom wall such that the legs of a pair of terminal elements are in opposed and spaced apart relation, and a plurality of slider-contactor units within the housing one for each pair of terminal elements, each unit having a slider, a contactor and a biasing means, each slider including a downwardly opening cavity of a depth substantially equal to the height of the slider, the lower surface of said slider being in closely spaced relation to said contacts, and an upwardly extending button actuator centrally disposed along said slider extending through an elongated opening in the top wall, each contactor being ball-shaped and engaging the contacts and sized to electrically connect the adjacent ends of the contacts when positioned therebetween, said contactor being slidably and matingly received by said cavity, and said biasing means being disposed within said slider and biasing said contactor into engagement with said contacts and said slider into engagement with said top wall whereby the curvate surfaces of the undulated arms and the contacts thereon coact with the biased contactor to define a detenting action during movement of the slider-contactor units.

31. The switch defined in claim 30, wherein said cavity of each slider is disposed along said slider such that in one position relative to the terminal contacts the slider will dispose the contactor in engagement with both contacts and when the slider is assembled in a reversed position the contactor will be in engagement with only one contact.

32. The switch defined in claim 31, wherein said biasing means is a helical spring.

33. A machine insertable slide DIP switch for a printed circuit board comprising, a base having a bottom wall, upstanding and opposed side and end walls, a plurality of juxtaposed pairs of terminals molded into the base at the bottom wall, each terminal including a fixed terminal arm disposed within the base and a terminal leg disposed outside the base for connection to a printed circuit board, the terminal arms of each terminal pair being of the same length, insulated from each other and in opposed aligned relation to define contacts for a switch site, said terminal arm being undulated to define an undulated surface on and along which a contactor moves between "on" and "off" positions, each arm having an arcuate surface at its inner end coacting with the arcuate surface of the other arm to define a pair of contacts for the contactor centrally between the housing side walls, a rise over which the contactor moves from the "on" position to the "off" position, and stop means for the contactor in the "off" position, a slider-contactor assembly for each switch site including a slider having a cavity extending from the bottom side to a depth slightly less than the height of the slider, a ball-shaped contactor slidably and guidably received in said cavity and over said contacts, and means biasing said contactor into engagement with said contacts, whereby slidable movement of said assembly will selectively position said contactor into engagement either with one contact for the "off" position or both contacts for the "on" position, and a cover secured to the upper open end of the base to close the base and retain the slider-contactor assemblies within the base, whereby the contactor coacts with the undulated contacts to define a detenting arrangement.

34. The switch defined by claim 33, wherein the cavity of each slider is disposed along the slider such that disposing the slider in one position in the base will position the contactor in engagement with both contacts and in a reverse position will position the contactor in engagement with only one contact.

* * * * *

UNITED STATES PATENT AND TRADEMARK OFFICE

CERTIFICATE OF CORRECTION

PATENT NO. : 4,590,344

DATED : May 20, 1986

INVENTOR(S) : Donald D. Kikta and Kent E. Regnier

It is certified that error appears in the above-identified patent and that said Letters Patent are hereby corrected as shown below:

Col. 7, line 66, change "slides" to --sliders--; and

Col. 9, line 47, change "detecting" to --detenting--.

Signed and Sealed this

*Thirtieth* Day of *September 1986*

[SEAL]

*Attest:*

DONALD J. QUIGG

*Attesting Officer*

*Commissioner of Patents and Trademarks*